US008523535B2

(12) United States Patent
Lamparski et al.

(10) Patent No.: US 8,523,535 B2
(45) Date of Patent: Sep. 3, 2013

(54) ADJUSTING VALVE FOR ADJUSTING THE DELIVERY VOLUME OF A DISPLACEMENT PUMP

(75) Inventors: Christof Lamparski, Mittelbiberach (DE); Jürgen Bohner, Bad Waldsee (DE)

(73) Assignee: Schwabische Huttenwerke Automotive GmbH & Co. KG, Aalen-Wasseralfingen (DE)

( * ) Notice: Subject to any disclaimer, the term of this patent is extended or adjusted under 35 U.S.C. 154(b) by 909 days.

(21) Appl. No.: 12/171,559

(22) Filed: Jul. 11, 2008

(65) Prior Publication Data

US 2009/0041605 A1 Feb. 12, 2009

(30) Foreign Application Priority Data

Jul. 13, 2007 (DE) ..... 10 2007 033 146

(51) Int. Cl.
*F04B 49/00* (2006.01)

(52) U.S. Cl.
USPC ..... 417/213; 417/300; 417/310; 417/364; 137/625.68; 137/625.65

(58) Field of Classification Search
USPC ..... 417/213, 231, 278, 282, 392, 300, 417/310, 364; 137/625.68, 625.65, 625.64
See application file for complete search history.

(56) References Cited

U.S. PATENT DOCUMENTS

| | | | | |
|---|---|---|---|---|
| 1,990,750 | A * | 2/1935 | Pigott | 418/21 |
| 3,644,063 | A * | 2/1972 | Bosch | 417/213 |
| 4,561,521 | A * | 12/1985 | Duffy | 180/422 |
| 4,809,504 | A * | 3/1989 | Izumi et al. | 60/430 |
| 4,877,099 | A * | 10/1989 | Duffy | 180/422 |
| 5,029,513 | A * | 7/1991 | Duffy | 91/31 |
| 5,174,338 | A * | 12/1992 | Yokota et al. | 137/625.64 |
| 5,179,330 | A * | 1/1993 | Nikolaus | 318/567 |
| 5,297,647 | A * | 3/1994 | Duffy | 180/423 |
| 5,392,875 | A * | 2/1995 | Duffy | 180/441 |
| 5,628,188 | A * | 5/1997 | Kordak | 60/449 |
| 5,876,185 | A * | 3/1999 | Schimpf et al. | 417/213 |
| 6,126,420 | A | 10/2000 | Eisenmann | |
| 6,244,839 | B1 * | 6/2001 | Cole et al. | 418/21 |
| 6,283,735 | B1 | 9/2001 | Schreiber et al. | |
| 6,328,535 | B1 * | 12/2001 | Brighton et al. | 417/220 |
| 6,345,595 | B2 * | 2/2002 | Yamada | 123/90.15 |

(Continued)

FOREIGN PATENT DOCUMENTS

| | | | |
|---|---|---|---|
| EP | 1 262 025 | B1 | 12/2002 |
| EP | 1 555 436 | A2 | 7/2005 |
| WO | WO-01/56169 | A1 | 8/2001 |
| WO | WO-03/058071 | A1 | 7/2003 |

*Primary Examiner* — Devon Kramer
*Assistant Examiner* — Joseph Herrmann
(74) *Attorney, Agent, or Firm* — RatnerPrestia

(57) ABSTRACT

An adjusting valve adjusting valve for adjusting the delivery volume of a displacement pump includes a valve casing, a valve piston which is mounted such that the valve piston can be moved within the valve casing, a valve spring which counteracts a force exerted by the valve-actuating pressure on the valve piston, and an adjusting device serving to adjust the valve piston in the direction of or counter to the force exerted by the valve-actuating pressure. A displacement pump exhibiting an adjustable delivery volume, includes a pump casing, a delivery chamber formed in the pump casing and a delivery member and the adjusting valve for adjusting the delivery volume, arranged in a flow of the fluid delivered by the delivery member.

35 Claims, 3 Drawing Sheets

(56) References Cited

U.S. PATENT DOCUMENTS

| | | | | |
|---|---|---|---|---|
| 6,413,054 | B1 * | 7/2002 | Geiger et al. | 417/219 |
| 6,619,928 | B2 * | 9/2003 | Konishi | 417/213 |
| 6,681,806 | B2 * | 1/2004 | Isobe | 137/625.65 |
| 6,935,851 | B2 | 8/2005 | Peters et al. | |
| 7,130,721 | B2 * | 10/2006 | Wear et al. | 700/282 |
| 7,219,636 | B2 * | 5/2007 | Sawada | 123/90.17 |
| 7,396,214 | B2 * | 7/2008 | Hunter et al. | 417/213 |
| 7,726,948 | B2 * | 6/2010 | Hunter et al. | 417/213 |
| 7,993,111 | B2 * | 8/2011 | Joshi et al. | 417/300 |
| 2005/0142006 | A1 | 6/2005 | Voigt | |
| 2007/0009372 | A1 | 1/2007 | Wockel et al. | |

* cited by examiner

ADJUSTING VALVE FOR ADJUSTING THE DELIVERY VOLUME OF A DISPLACEMENT PUMP

CROSS-REFERENCE TO RELATED APPLICATIONS

The present application claims priority from German Patent Application No. 10 2007 033 146.2, filed on Jul. 13, 2007, which is incorporated herein by reference in its entirety.

FIELD OF THE INVENTION

The present invention relates to an adjusting valve for adjusting the delivery volume of a displacement pump and to a displacement pump comprising the adjusting valve which is arranged in a fluid cycle of the pump for adjusting the delivery volume of a fluid which is to be delivered by the pump. Accordingly, the invention also relates to the adjusting valve itself, when provided for adjusting the delivery volume of a displacement pump.

BACKGROUND OF THE INVENTION

Displacement pumps deliver fluids at a volume flow which is proportional to the speed of the pump. The delivery volume per revolution or per reciprocal stroke—the so-called specific volume flow—is constant or can at least be regarded as a good approximation of constant in practice. The constancy per revolution or stroke and accordingly the proportionality to the speed of the pump is for example an interference in applications in which the assembly to be supplied by the respective pump has a fluid requirement which is lower in one or more speed range(s) of the pump than the volume flow resulting from the proportionality. In the respective speed range, the pump accordingly delivers a volume flow which is above the requirement and is channeled away with losses. This problem is described in U.S. Pat. No. 6,126,420, which already discloses an internal gear pump exhibiting an adjustable delivery volume for solving the problem.

U.S. Pat. No. 6,244,839 B1 likewise discloses an internal gear pump exhibiting an adjustable delivery volume. For adjusting, the inner toothed wheel can be axially shifted relative to the outer toothed wheel. The inner toothed wheel is part of an axially shifting adjusting unit which is formed as a piston which acts on both sides. Via a 4/3 adjusting valve, the adjusting unit is charged with the fluid which is delivered by the pump. The adjusting valve comprises a valve casing and a valve piston which can be axially moved back and forth within the valve casing and is charged at one axial end with the delivered fluid and at the other axial end with a force of a valve spring which counteracts the pressure of the fluid. The position of the valve piston is set in accordance with the equilibrium of the force of the valve spring and the force generated by the fluid pressure. The adjusting valve is configured such that when a fluid pressure predetermined by the valve spring is reached, the adjusting unit is moved out of an axial position for a maximum delivery volume towards an axial position for a minimum delivery volume. The biasing force of the valve spring is set beforehand at the adjusting valve.

WO 03/058071 A1 discloses a displacement pump comprising an adjusting valve in which the movable valve piston for adjusting the delivery volume of the pump is charged in an axial direction with fluid from the high-pressure side of the pump and charged counter to the fluid with a spring force. In order to be able to lower the fluid pressure which the pump is regulated down to, a control device for the adjusting valve is provided which exerts an additional force on the valve piston. An electric step motor for adjusting the biasing force of the valve spring and a magnetic coil for generating an additional magnetic force may be cited as examples of control devices. The fluid flow connected by means of the adjusting valve acts on a shifting unit of the pump in the direction of a maximum delivery volume only, while the pressure of the high-pressure side constantly acts in the opposite direction.

SUMMARY OF THE INVENTION

The present invention flexibly and precisely adapts the delivery volume of a displacement pump to the requirement of an assembly to be supplied, and to constantly ensure a sufficient supply to the assembly.

The invention proceeds on the basis of a displacement pump for supplying an assembly with fluid, which comprises a pump casing including a delivery chamber, and a delivery member which can be moved within the delivery chamber and which acts directly on the fluid in order to deliver it through the delivery chamber. When a delivery movement is performed, the delivery member alone or in cooperation with one or as applicable more other delivery member(s) can deliver the fluid from an inlet of the delivery chamber through an outlet of the delivery chamber by increasing the pressure. The inlet is assigned to a low-pressure side of the pump, and the outlet is assigned to a high-pressure side of the pump. The pump is preferably arranged in a closed fluid cycle, but can in principle also serve to deliver the fluid in an open fluid cycle. When integrated in a closed fluid cycle, it suctions the fluid on the low-pressure side from a reservoir through the inlet into the delivery chamber and delivers it on the high-pressure side to the assembly or as applicable to the plurality of assemblies to be supplied with the fluid. Downstream of the assembly or assemblies, the fluid re-enters the reservoir, thus closing the fluid cycle. The pump can for example be used for supplying a hydraulic press with pressure fluid. In exemplary embodiments, it is installed or is provided for being installed in a motor vehicle, in order to supply an internal combustion engine which drives the motor vehicle with lubricating fluid or to supply an automatic transmission with hydraulic fluid. Preferably, the internal combustion engine drives the pump.

The displacement pump also comprises an adjusting valve, by means of which the delivery volume of the pump can be adjusted in accordance with the requirement of the at least one assembly to be supplied, and the energy required for driving the pump can preferably be reduced accordingly. The adjusting valve comprises a valve casing, a valve piston which can be moved within the valve casing, a valve spring and an adjusting device. The valve piston comprises an active surface for a fluidic valve-actuating pressure. The valve spring is arranged such that it acts on the valve piston, counter to the valve-actuating pressure acting on the valve body as a whole.

In exemplary embodiments, the delivery volume is understood to be the specific volume flow of the pump itself—the volume flow per revolution in the case of a rotational pump, and the volume flow per stroke in the case of a reciprocating piston pump. Although less preferred, the pump can also be a constant pump and the adjusting valve can be arranged on the high-pressure side of the pump as a bypass valve, in order to deliver fluid which has been delivered to excess into the reservoir, avoiding the at least one assembly. Such a bypass delivery does not reduce the energy consumption of the pump, but does ensure a delivery according to requirement. In such embodiments, it is not the delivery volume at the outlet of the delivery chamber but rather the delivery volume delivered to the at least one assembly which is controlled or regulated according to requirement. A pump which can be adjusted in its delivery volume can also be combined with such a bypass valve, by adjusting the volume flow per revolution or stroke via an adjusting valve in accordance with the invention or in some other way, and feeding a portion of the volume flow delivered by the pump back into a reservoir, branched off and unused, downstream of the pump but upstream of the assembly to be supplied.

In exemplary embodiments, the delivery volume of the pump itself, as viewed directly at the outlet of the delivery chamber, is adjusted by means of the adjusting valve. In such embodiments, an actuating member is movably arranged in the pump casing and can be charged in the direction of its mobility with an actuating force which is dependent on the requirement of the at least one assembly. The actuating member can in particular be arranged facing a front face of the delivery member or surrounding the delivery member. In first variants, the actuating member and the delivery member are part of an adjusting unit which can be moved back and forth within the pump casing as a complete unit, for example an adjusting unit which can be moved linearly or can be pivoted or moved in other ways, transverse to a rotational axis of the preferably rotatable delivery member. Examples of such adjusting units are for example described in U.S. Pat. No. 6,283,735 B1 for external-axle pumps, in U.S. Pat. Nos. 6,126,420 and 6,244,839 B1 for internal-axle pumps, and in EP 1 262 025 A2 for both types of pump. In second variants, the actuating member can be adjusted relative to the delivery member and the pump casing. The actuating member of the second variant can in particular be an actuating ring surrounding the delivery member, such as is known from vane pumps including vane cell pumps, pendulum slider pumps and internal gear pumps, in order to adjust the eccentricity with respect to the delivery member, for example by a linear reciprocating or pivoting movement of the actuating member.

The actuating force is preferably generated fluidically, in that the actuating member forms an actuating piston which is charged with a pressure fluid. This pressure fluid can in particular be branched off on the high-pressure side of the pump and fed back to the actuating member via the adjusting valve as a partial flow of the volume flow delivered by the pump as a whole. In principle, however, the pressure fluid with which the actuating member is charged can also be another fluid, for example a fluid which is provided from a pressure reservoir or from another pump.

In another variant, a partial flow of the fluid is fed back to the low-pressure side via the adjusting valve into the delivery chamber, in order to increase the fill level of delivery cells therein, as disclosed for example in U.S. Pat. No. 6,935,851 B2. Feeding back to and filling the delivery cells also simultaneously adjusts the delivery volume, wherein this type of adjustment can also be realized in combination with one of the other types already cited.

In accordance with the invention, the adjusting device is formed such that it can adjust the valve piston in the direction of the force exerted by the valve-actuating pressure on the valve body or counter to the valve-actuating pressure. It preferably acts electromagnetically. The word "or" in the sense of the invention includes, here as elsewhere, the meaning of "either . . . or" and the meaning of "and", providing a limited meaning does not necessarily follow from the respective context. Accordingly, the adjusting device can be constructed such that it only counteracts the force of the valve-actuating pressure or preferably only counteracts the valve spring and in the same direction, and it can alternatively also be constructed such that it can adjust the valve piston both in the direction of and counter to the force of the valve-actuating pressure.

In a first exemplary embodiment, the valve-actuating pressure and a force exerted on the valve piston by the adjusting device act together counter to the force of the valve spring. If the valve-actuating pressure increases, the valve piston can be adjusted by means of a correspondingly smaller force of the adjusting device counter to the force of the valve spring.

In a second exemplary embodiment, the adjusting device is configured to adjust the valve piston both in the direction of the valve-actuating pressure and counter to the valve-actuating pressure. If the adjusting device is a magnetic adjusting device comprising only a single magnetic coil, then the polarity of the magnetic coil can be reversed in such embodiments. Alternatively, a dedicated magnetic coil can be provided for each of two directions of the mobility of the valve piston, each comprising an anchor, and one of these anchors exerts a force on the valve piston in one direction of the mobility of the valve piston and the other anchor exerts a force on the valve piston in the other direction of the mobility of the valve piston, in order to move the valve piston back and forth.

The position of the valve piston can thus be adjusted relative to the valve casing independently of the valve-actuating pressure acting on the active surface, at least in the second embodiment and preferably also in the first embodiment, and accordingly the delivery volume of the pump can be set. The adjusting valve can thus adaptively set the delivery volume over a greater operating range of the assembly to be supplied, continuously or incremented as desired, and not only adapted to a certain pressure which the delivery volume is regulated down to.

A control device or regulating device for the adjusting valve is preferably configured such that the delivery volume can be adaptively adjusted over the entire operating range of the assembly by means of the adjusting valve. Conversely, the valve spring and the valve-actuating pressure which constantly counteracts the force of the valve spring ensure a reliable supply to the assembly, even if, in the event of the adjusting device failing, only by regulating the delivery volume in accordance with the biasing force and spring constants of the valve spring, as is known from conventional displacement pumps. The invention combines a precise and flexible adaptability to the requirement with a reliability of supply which is ensured even in the event of the adjusting device failing; it provides so-called second-level control or second-level regulation for the delivery volume.

The adjusting valve is preferably a proportional valve. It is preferably controlled electrically. The adjusting device preferably acts magnetically. It can comprise a proportional magnetic coil which is voltage-controlled or voltage-regulated or current-controlled or current-regulated, i.e. by varying the voltage or electric current applied in accordance with the requirement of the at least one assembly. In other preferred embodiments, the adjusting valve is controlled or regulated by modulated pulses. When using a pulse-modulated adjusting valve, it is possible to vary the duration of the individual pulses or the time interval between two consecutive pulses of the actuating variable, which also includes the case in which both the pulse duration and the time duration between consecutive pulses is varied in accordance with the requirement. The period duration of the actuating variable is preferably constant. Preferably, a pulse-width-modulated adjusting valve is used. The period duration of the actuating variable for the adjusting valve is significantly smaller than the determining time constant of the displacement pump for adjusting the delivery volume. The pulse modulation utilizes the low-pass character of the pump. By varying the on-time of pulse width modulation or the time interval in the case of pulse frequency modulation in accordance with the requirement, the flow through the adjusting valve and consequently the delivery volume of the displacement pump can be controlled or regulated near-continuously in accordance with the current requirement of the assembly.

The adjusting valve is preferably a manifold valve comprising at least three ports, preferably four ports. It can preferably be switched between at least two switching positions, more preferably at least three switching positions.

In exemplary embodiments, the adjusting valve is controlled or regulated in accordance with a nominal value for the volume flow to be delivered by the displacement pump or for a fluid supply pressure to be generated by the displacement pump. A nominal value preset predetermines the nominal value of a control device or regulating device which is provided for the adjusting valve. The nominal value is preferably varied in accordance with the requirement of the assembly. Preferably, a characteristic diagram is predetermined for the nominal values which are dependent on the operational state of the assembly. The at least one nominal value, or more preferably the plurality of nominal values, is/are predetermined in accordance with a physical variable which is characteristic of the operational state and is ascertained using a sensor during the operation of the assembly by means of a detection device. The at least one physical variable can in particular be a temperature, a rotational speed or a load state of the assembly. Preferably, the nominal value or values for the volume flow or the fluid supply pressure is/are predetermined in accordance with at least two variables which characterize the operational state of the assembly. If the displacement pump is used as a lubricating oil pump for an internal combustion engine, the temperature of the lubricating oil or of the cooling fluid in the region of the internal combustion engine or the rotational speed or, for the load state, the position of the accelerator pedal or throttle can for example be detected using a sensor, and the corresponding nominal value can be ascertained from this on the basis of the characteristic diagram and predetermined on the control device or regulating device for the adjusting valve.

In a first exemplary embodiment, the adjusting valve is controlled only in accordance with the respective nominal value. Detecting an actual value of the physical variable forming the nominal value, which is representative of the requirement, i.e. the volume flow or fluid supply pressure, is omitted, as is any elaborate processing for regulating on the basis of a nominal/actual comparison.

In a second exemplary embodiment, the adjusting valve is regulated in accordance with a nominal/actual comparison of the respective nominal value and an actual value of the volume flow or fluid supply pressure which is measured continuously or at sufficiently small time intervals. Regulating is advantageous in such cases, in which the volume flow requirement of the assembly changes in the course of the service life of the assembly due to wear.

In an optional combination of the two embodiments, a checking device is provided which can change from controlling in accordance with the first embodiment to regulating in accordance with the second embodiment, wherein it is preferred if the adjusting valve is first controlled on the basis of the predetermined volume flow and, as losses due to leaks as a result of wear on the assembly increase, is subsequently changed to pressure regulation. In yet another embodiment, an adaptive checking device is provided which determines an increase in wear on the basis of detecting the volume flow or fluid supply pressure using a sensor and adaptively shifts the nominal value or the characteristic diagram of the nominal value, at least once or in a plurality of increments, as applicable continuously during the service life of the assembly.

In another exemplary embodiment, the adjusting valve is on the one hand controlled on the basis of a nominal value or a characteristic diagram of the nominal value for the fluid supply pressure or the volume flow and is additionally current-regulated. One particularly preferred embodiment is an adjusting valve which is controlled on the basis of one or more nominal values and/or a characteristic diagram of the nominal value for the fluid supply pressure or the volume flow by means of pulse width modulation and is additionally current-regulated. Changes in the electrical resistance of a magnetic adjusting device are advantageously equalized by current-regulating. The current uptake in the magnetic adjusting device is detected, and the changes in the magnitude of the electric current due to changes in resistance are equalized by regulating the duty cycle in accordance with the variation in current uptake. However, it is possible to proceed accordingly not only for the preferred embodiment as a pulse-width-modulated adjusting valve but also in adjusting valves controlled in other ways. By current-regulating in addition to controlling on the basis of a nominal value or a characteristic diagram of the nominal value for the volume flow or the fluid supply pressure, it is possible to omit regulating the volume flow or the pressure, although even in the case of current-regulating, additionally regulating the volume flow or the pressure can be employed.

The control device or regulating device can be an integrated part of the adjusting valve or can be installed separately from it. The nominal value preset can be realized as an objective part of the control device or regulating device or can objectively be realized separately from the other parts of the control device or regulating device. The adjusting valve is preferably an integrated part of the displacement pump and is for example mounted on the pump casing. In the integrated embodiment, the adjusting valve can also advantageously be arranged in the casing of the displacement pump, for example in an accommodating bore or otherwise formed accommodating space in a wall of the pump casing. In such embodiments, the ports of the adjusting valve can be formed in a space-saving and weight-saving way as bores or otherwise formed channels in the casing, in particular in said wall of the casing. Accordingly, the pump casing can also simultaneously form the valve casing or also only a part of the valve casing.

In the embodiments in which the delivery volume of the pump directly is adjusted, it is advantageous if the actuating member is formed as a double-action actuating piston comprising two piston surfaces which face axially away from each other and preferably face oppositely away from each other, and either one or the other piston surface, or as applicable both piston surfaces, can be charged with a pressurized pressure fluid by means of the adjusting valve.

If the actuating member forms an actuating piston which can be charged with pressure fluid, for example a piston which can only be charged with pressure fluid on one side or preferably a double-action piston, then in exemplary embodiments, it is charged with a spring force by a pump spring, wherein the pump spring acts in the direction of increasing the delivery volume of the pump. If the actuating member forms a double-action piston, it is preferred if the pump spring is weak enough that the adjustment dynamics of the pump are not critically affected by the pump spring, but rather exclusively or at least to a significantly predominant extent by the adjusting valve. In such embodiments, a pump spring can also in principle be omitted. Conversely, using a weak pump spring is advantageous, wherein such a pump spring is configured such that it only ensures that when the displacement pump is running at a low speed, the maximum delivery volume for this speed of the pump is delivered. A pump spring which exerts, on the actuating member, a spring force corresponding to a fluid pressure of at most 1 bar is sufficient.

The fluid which is guided (e.g., controlled or regulated) to the displacement pump by means of the adjusting valve for the purpose of adjustment or, if the adjusting valve is used only as a bypass valve, the fluid which is branched off to a reservoir preferably generates the valve-actuating pressure as it flows through the adjusting valve. In such embodiments, a separate port for generating the valve-actuating pressure is not required. The same inlet through which the fluid flow which flows through the adjusting valve enters the adjusting valve also forms the port for the fluid which generates the valve-actuating pressure.

It is preferred if the valve-actuating pressure is generated by means of a plurality of active surfaces, preferably precisely two active surfaces, which differ in size in such a way that the valve-actuating pressure exerts a differential force on the valve piston in accordance with the difference in area of the active surfaces. The feature of the differential force is particularly preferably combined with the additional feature according to which the fluid also simultaneously generates the valve-actuating pressure as it flows through the adjusting valve.

In one development, the biasing force of the valve spring can be adjusted, preferably fluidically, while the displacement pump delivers the fluid. The adjusting valve can then comprise another piston which preferably serves only to set the biasing force and is preferably charged with the fluid which also generates the valve-actuating pressure, wherein a separate port can be provided for the piston for adjusting the biasing force or preferably a force acting on this adjusting piston can also be generated by the fluid flowing through.

Advantageous features are also described in the sub-claims and combinations of them.

BRIEF DESCRIPTION OF THE DRAWINGS

An exemplary embodiment of the invention is explained below on the basis of figures. Features disclosed by the exemplary embodiment, each individually and in any combination of features, advantageously develop the subjects of the claims and the embodiments described herein. There is shown:

DETAILED DESCRIPTION OF THE INVENTION

Figure 1:
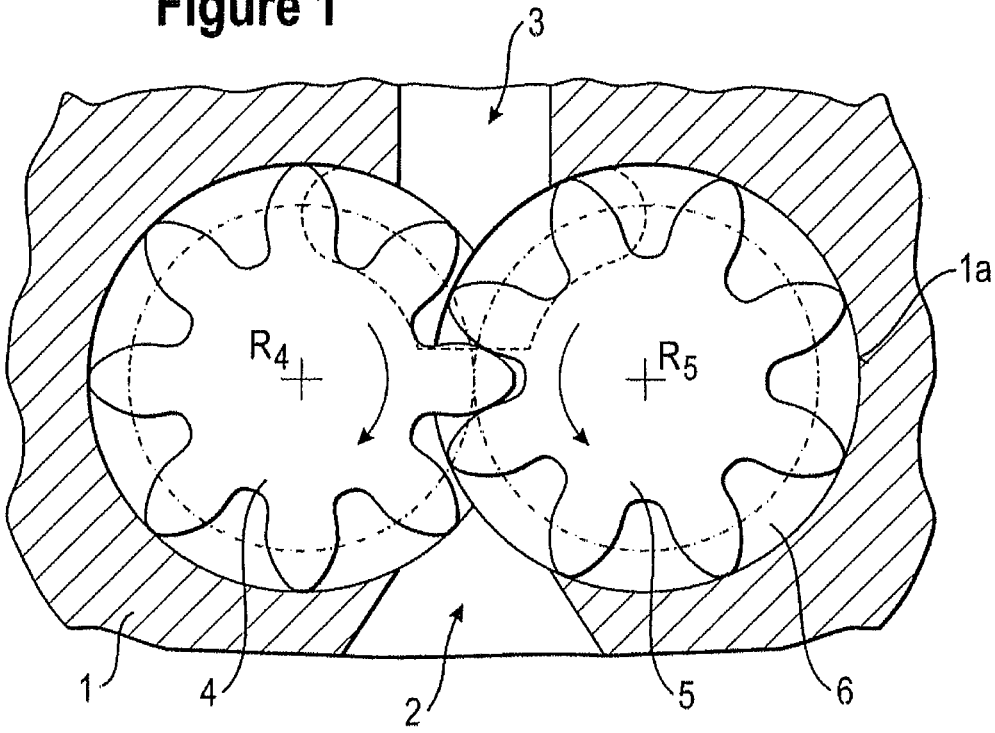
FIG. 1 a displacement pump in a cross-section.

FIG. 1 shows a displacement pump in a cross-section. A delivery chamber comprising an inlet 2 on a low-pressure side and an outlet 3 on a high-pressure side is formed in a pump casing 1. A first delivery member 4 and a second delivery member 5 are movably arranged in the delivery chamber. The delivery members 4 and 5 are in a delivery engagement with each other. When the delivery members 4 and 5 are driven in the delivery engagement, they perform a delivery movement which suctions a fluid, for example lubricating oil or a hydraulic fluid, through the inlet 2 into the delivery chamber and displaces it through the outlet 3 at a higher pressure. The delivery member 4 is driven and, in the delivery engagement, drives the delivery member 5.

The displacement pump of the exemplary embodiment is an external gear pump. Accordingly, the delivery members 4 and 5 are delivery rotors exhibiting an external, circumferential toothing, and the delivery engagement is a toothed engagement. The delivery members 4 and 5 are mounted such that they can rotate about one rotational axis $R_4$ and $R_5$ each. When they are rotary-driven, the suctioned fluid is transported from the inlet 2, in delivery cells formed by the tooth gaps in each of the delivery members 4 and 5, through the region of the so-called enclosure 1*a* and is expelled through the outlet 3.

In order to be able to adapt the delivery volume of the pump to the requirement of an assembly which is to be supplied with the fluid, the axial length of the delivery engagement of the delivery members 4 and 5 as measured along the rotational axes $R_4$ and $R_5$—the engagement length—can be adjusted. For adjusting, the delivery member 5 can be axially moved back and forth relative to the delivery member 4 and the pump casing 1 between a position of maximum engagement length and accordingly maximum delivery volume and a position of minimum engagement length and accordingly minimum delivery volume.

Figure 2:
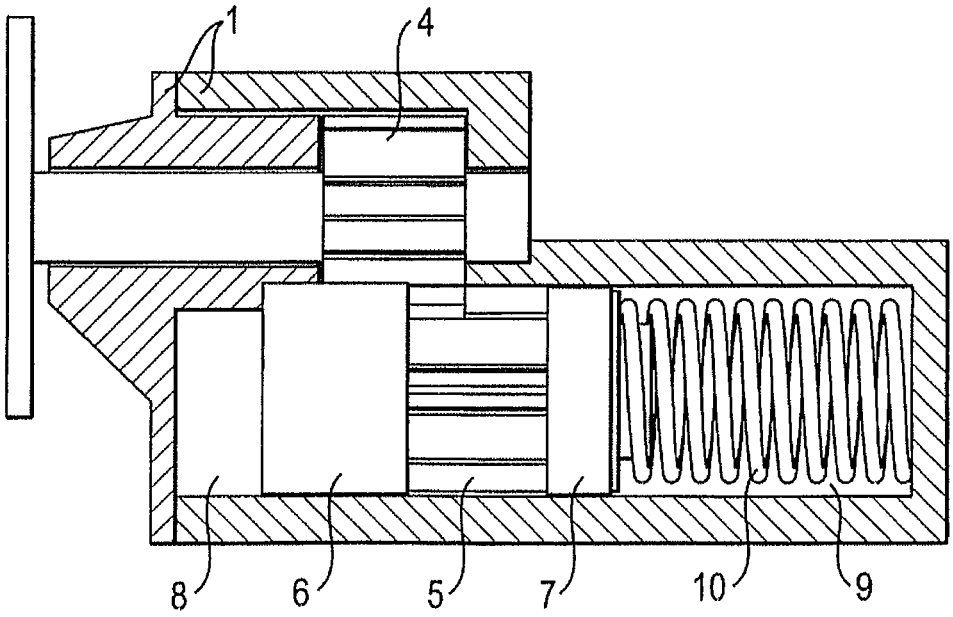
FIG. 2 the displacement pump of FIG. 1 in a longitudinal section.

FIG. 2 shows the displacement pump in a longitudinal section. The delivery member 4 is fastened, secured against rotating, on a drive shaft which protrudes from the pump casing 1 and bears a drive wheel for driving the pump. The delivery member 5 is part of an adjusting unit which, in addition to the delivery member 5, comprises an actuating member comprising two actuating pistons 6 and 7. This adjusting unit 5-7 can be axially moved back and forth as a complete unit within the pump casing 1, in order to be able to adjust the engagement length. The delivery member 5 is axially arranged between the actuating pistons 6 and 7. The actuating member 6, 7 mounts the delivery member 5 such that it can rotate about the rotational axis $R_5$. The adjusting unit 5-7 is accommodated in a cylindrical hollow space of the pump casing 1. The hollow space forms an axial track for the movements of the adjusting unit 5-7. It also forms one pressure space 8 on one axial side of the adjusting unit 5-7 and another pressure space 9 on the other side. The actuating pistons 6 and 7 fluidically separate the two pressure spaces 8 and 9 from each other and from the delivery chamber, aside from inevitable losses due to leaks. The pressure spaces 8 and 9 can each be pressurized by a pressurized fluid—in the example embodiment, the fluid delivered by the displacement pump. A pump spring 10 is arranged in the pressure space 9, wherein the spring force of said spring acts on the adjusting unit 5-7, namely on the actuating piston 7, in the direction of maximum engagement length.

Figure 3:
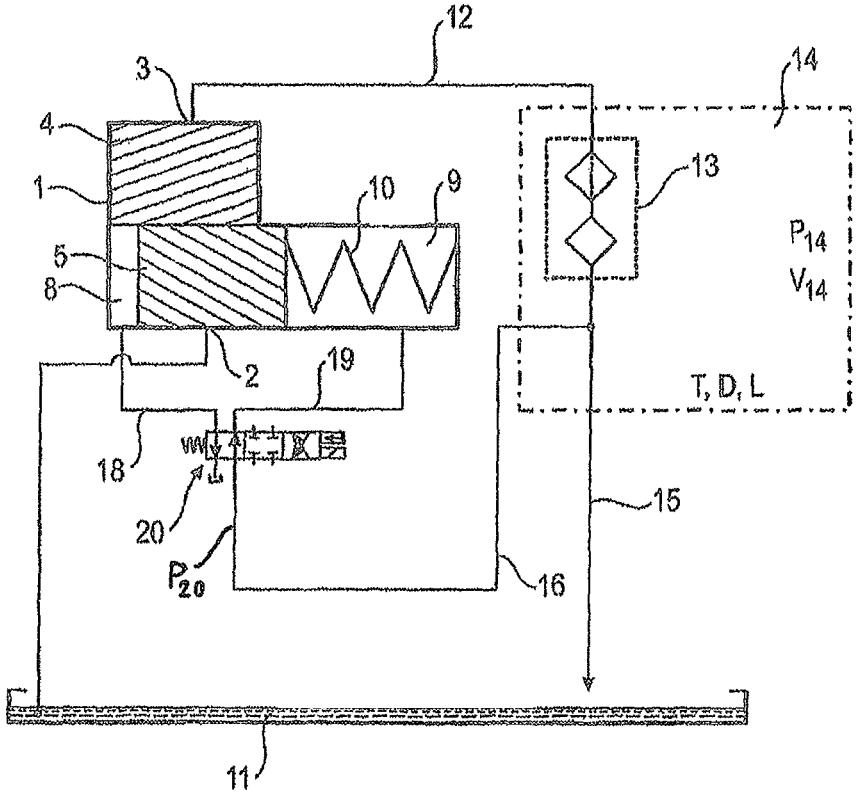
FIG. 3 the displacement pump of FIG. 1, comprising an adjusting valve for adjusting the delivery volume of the pump.

FIG. 3 shows the displacement pump integrated into a closed fluid cycle, for example a lubricating oil cycle of a motor vehicle. The fluid cycle contains a reservoir 11, from which the pump suctions the fluid on the low-pressure side through the inlet 2 and delivers it at a higher pressure on the high-pressure side through the outlet 3, an attached supply conduit 12 and via a cooling and cleaning device 13 comprising a cooler and a filter, to the assembly 14 which is to be supplied with the fluid, for example an internal combustion engine for driving a motor vehicle. Downstream of the assembly 14, the fluid is fed back into the reservoir 11 through a conduit 15.

Downstream of the cooling and cleaning device 13, in particular downstream of the cleaning portion of the cooling and cleaning device 13, but still upstream of the assembly 14, a partial flow 16 of the fluid is branched off and fed back to the pump via an adjusting valve 20. The adjusting valve 20 comprises an inlet for the partial flow 16, an outlet which is shorted to the reservoir 11, and two other ports, one of which is connected to the pressure space 8 via a conduit 18 and the other of which is connected to the pressure space 9 via a conduit 19. The adjusting valve 20 is a manifold switching valve. In a first switching position, it guides the partial flow 16 into the pressure space 8 and connects the pressure space 9 to the reservoir 11, i.e., it connects the pressure space 9 to ambient pressure. In a second switching position, which the adjusting valve 20 adopts in FIG. 3, it reverses these conditions, by guiding the partial flow 16 into the pressure space 9 and shorting the pressure space 8 to the reservoir 11. The adjusting valve 20 of the exemplary embodiment can adopt three switching positions, namely the two switching positions cited and also a middle position in which it separates the pressure spaces 8 and 9 from each other and also from the reservoir 11 and the partial flow 16, such that the respective pressure in the pressure spaces 8 and 9 remains intact, aside from leaks and associated losses due to leaks. In the example embodiment, a 4/3-port valve can be chosen for the adjusting valve 20.

Figure 4:
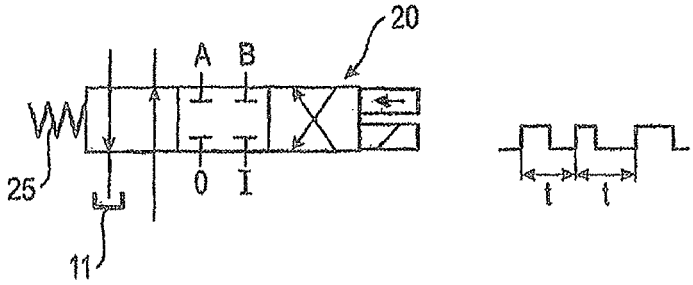
FIG. 4 the adjusting valve of FIG. 3, constituently as graphical symbols.

FIG. 4 shows the adjusting valve 20 as graphical symbols as in FIG. 3, but in an enlarged representation. The four ports of the adjusting valve 20 are indicated, of which the inlet for the partial flow 16 fed back is indicated as I, the outlet to the reservoir 11 is indicated as O, the port for the pressure space 8 is indicated as A and the port for the pressure space 9 is indicated as B.

The adjusting valve 20 is a proportional valve exhibiting a constantly acting fluidic valve-actuating pressure $P_{20}$, namely the pressure of the fluid being fed back in the partial flow 16, and comprising a valve spring 25 which is arranged to counteract the valve-actuating pressure $P_{20}$. When the adjusting valve 20 is functioning properly, the fluidic valve-actuating pressure $P_{20}$ and the force of the valve spring 25 alone do not however determine the switching position. The adjusting valve 20 comprises an adjusting device as the proportional valve, which respectively switches the adjusting valve 20 from one of the switching positions to another in accordance with the fluid requirement of the assembly 14. The valve-actuating pressure $P_{20}$ and the valve spring 25 imbue the adjusting valve 20 with a fail-safe characteristic, in the event of the proportional adjusting device failing.

The adjusting device is a magnetic adjusting device which is connected to a pulse-width-modulated electrical actuating signal. The actuating signal is generated by a control device in the form of a rectangular signal exhibiting a constant upper and lower signal level, for example voltage level, and a certain period duration t. The time duration of the upper signal level, the so-called on-time, and consequently the time duration of the lower signal level, the off-time, can be varied in accordance with the pulse width modulation. The magnetic force of the adjusting device changes in accordance with the duty cycle of the actuating signal, i.e. in the ratio between the on-time and the period duration t. The switching position of the adjusting valve 20 follows from the force equilibrium of the force of the valve spring 25 and from the two counteracting forces, i.e. the fluidic force generated by the valve-actuating pressure $P_{20}$ and the magnetic force. The greater the valve-actuating pressure $P_{20}$, the smaller the magnetic force which corresponds to an equilibrium of the forces. If the sum of the fluidic force and the magnetic force exceeds the spring force, the valve piston 22 is moved in the direction of the first switching position, and the delivery volume of the displacement pump is regulated. If the force of the valve spring 25 predominates, the valve piston 22 is moved into the second switching position, and the adjusting unit 5-7 is accordingly moved in the direction of a maximum delivery volume.

In one modification, the on-time and the off-time are assigned to the first and second switching position of the adjusting valve 20. When the adjusting device is functioning properly, the position of the valve piston 22 and consequently the switching position of the adjusting valve 20 is decoupled from the valve-actuating pressure $P_{20}$. By way of example, it may be assumed that the adjusting valve 20 adopts the first switching position, in which the fluid of the partial flow 16 is fed back into the pressure space 8, during each on-time and adopts the second switching position, in which the fluid is fed back into the pressure space 9, during each off-time.

By varying the on-time and accordingly the off-time, it is possible in both embodiments to practically continuously vary the flow through the adjusting valve 20 to the respective pressure space 8 or 9 due to the period duration t of the actuating signal which is significantly shorter than the critical time constant of the pump. Accordingly, the pressure in the pressure space 8 and the pressure in the pressure space 9 can also be altered continuously.

The adjusting unit 5-7 can consequently be moved to and held in any axial position along its axial adjustment path. The delivery volume can thus be continuously adapted flexibly and precisely to the fluid requirement of the assembly 14, between the maximum and minimum delivery volume.

For supplying the assembly 14 according to requirement, a characteristic diagram is stored in an electronic or optical memory in a control system of the assembly 14—in the example embodiment, an engine control system. For each of the operational states of the assembly 14 which are relevant with regard to the fluid requirement, the characteristic diagram contains a predetermined nominal value for the fluid supply pressure $P_{14}$ or the volume flow $V_{14}$ which the assembly 14 requires in the respective operational state. These volume flow nominal values or pressure nominal values are stored in the characteristic diagram in accordance with physical variables which characterize the operational states which are to be distinguished with regard to the fluid requirement. The temperature T, the rotational speed D and the load L may be cited as examples of the physical variables. The assembly 14 comprises a detection device for detecting one or more physical variable(s) which characterize(s) different operational states. The temperature T can for example be measured at a critical location on the assembly 14, in a cooling fluid serving to cool the assembly 14 or in the fluid delivered by the pump 3. The rotational speed D can be very easily detected by means of a tachometer, and the load L can be very easily detected via the position of the accelerator pedal or throttle. In accordance with the detected variables, a nominal value preset selects the assigned pressure nominal value or volume flow nominal value on the basis of the characteristic diagram and feeds it to the control device for the adjusting valve 20. The control device forms the actuating signal, i.e. the ratio between the on-time and the period duration t, in accordance with the current nominal value. A feedback by means of a regulating variable, in the present case, a measured actual value of the fluid supply pressure $P_{14}$ or the volume flow $V_{14}$, is not required as long as the actual fluid requirement of the assembly 14 corresponds to the nominal value.

Controlling on the basis of the nominal value can in particular be supplemented by current-regulating. Current-regulating serves in particular to compensate for changes in the resistance of the magnetic adjusting device, such as can occur above all during changes in temperature, wherein the current uptake in the adjusting device is detected by a detection device and held at a certain current. If the detection device determines a change in the current uptake and accordingly in the electrical resistance of the adjusting device, the duty cycle is altered in such a way that the current uptake again corresponds to the current value before the change in resistance.

If the actual fluid requirement of the assembly 14 changes and deviates from the nominal values of the characteristic diagram, for example due to wear in the course of the service life of the assembly 14, a regulating device is also provided for the adjusting valve 20. The regulating device forms the actuating signal for the adjusting valve 20 in accordance with a nominal/actual comparison on the basis of a fluid supply pressure $P_{14}$ or volume flow $V_{14}$ required for the assembly 14. The regulating device has access to a memory in which other nominal values of the pressure $P_{14}$ or volume flow $V_{14}$ are stored in the form of a characteristic diagram comparable to the characteristic diagram hitherto used for controlling. The characteristic diagrams of the pressure nominal values or volume flow nominal values can be stored in physically different memories or in different regions of same memory. A superordinate checking device is also provided, which can be part of the pressure or volume flow control device or regulating device and changes from controlling to regulating when it is determined that the requirement of the assembly has changed enough that the characteristic diagram of the nominal values no longer adequately describes the actual requirement, for example because the requirement has increased due to wear. For the nominal/actual pressure comparison, the actually prevailing fluid supply pressure $P_{14}$ can for example be detected at the most downstream location of consumption on the assembly 14 or, in the example case of the internal combustion engine, on the engine gallery, and can be compared with the pressure nominal value which is critical to the respective operational state, for example by finding the difference between the nominal value and actual value.

Controlling the pressure or volume flow without feedback, as described by way of example, can be developed into regulating the pressure or volume flow using a nominal/actual comparison between the respective pressure nominal value or volume flow nominal value and an actual value to be measured for the comparison. A plurality of characteristic diagrams for the volume flow $V_{14}$ or the fluid supply pressure $P_{14}$ can be stored beforehand, which describe the requirement for different points in time within the life cycle of the assembly 14, for example a characteristic diagram for the first n kilometers of a motor vehicle or n operating hours of the assembly 14, the following m kilometers of the vehicle or m operating hours of the assembly, etc. In such embodiments, it is possible to change from the characteristic diagram used first to the next characteristic diagram, etc., on the basis of for example the kilometer reading of the vehicle or a record of the operating duration. Lastly, the control device can also be capable of altering the nominal values of the characteristic diagram in accordance with the state of the assembly 14, in order to be able to respectively control the adjusting valve 20 on the basis of the altered characteristic diagram, in better accordance with the respective state of the assembly 14. Advantageously, the nominal values of the characteristic diagram are automatically changed or one or more predetermined characteristic diagrams are automatically selected, for example on the basis of the kilometer reading or operating duration already cited, or on the basis of detecting the fluid supply pressure $P_{14}$ and comparing it with a predetermined nominal value or predetermined nominal values in the form of a characteristic diagram, wherein such a nominal/actual comparison could be used for regulating the pressure of the adjusting valve 20 but is preferably used merely for selecting the pressure characteristic diagram or volume flow characteristic diagram to be used or for altering the pressure nominal values or volume flow nominal values of a single predetermined characteristic diagram, for controlling.

Figure 5:
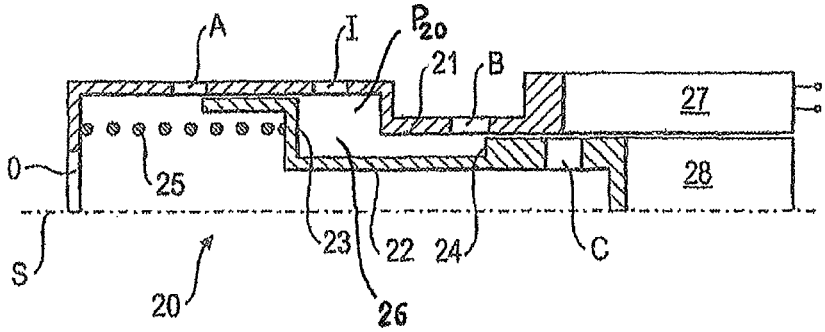
FIG. 5 the adjusting valve of FIGS. 3 and 4 in a longitudinal section.

FIG. 5 shows a longitudinal section of an adjusting valve 20.

The adjusting valve 20 comprises a valve casing 21 and a valve piston 22 which can be axially moved back and forth within the valve casing 21 along a central valve axis S. Of the adjusting device, a magnetic coil 27 and an anchor 28 formed from soft iron are shown. The electrical contacts of the magnetic coil 27 are also indicated. The magnetic coil 27 is fixedly connected to the valve casing 21 and surrounds the anchor 28. The anchor 28 is connected to the valve piston 22 such that it cannot move axially, such that the valve piston 22 and the anchor 28 perform axial movements as one unit.

The valve piston 22 comprises a first active surface 23 and a second active surface 24 for the valve-actuating pressure $P_{20}$. The active surfaces 23 and 24 together axially limit a fluid space 26 and face each other axially. The active surface 23, onto which the valve-actuating pressure $P_{20}$ counteracts the valve spring 25, is greater than the active surface 24, wherein in FIG. 5, the ratios are shown in an exaggeration. The difference in size is actually only slight, but is defined such that the valve-actuating pressure $P_{20}$ constantly exerts, on the valve piston 22, a differential force which corresponds to the difference in the size of the active surfaces 23 and 24 and counteracts the force of the valve spring 25. Since the valve piston 22 can be manufactured to the difference in the size of the active surfaces 23 and 24 very precisely, the differential force can also be correspondingly small and the valve spring 25 can also be advantageously softer than in the example embodiment of FIG. 4. The adjusting device 27, 28 requires correspondingly smaller forces. The adjusting valve 20 as a whole is more sensitive, and the switching times of the adjusting valve 20 can be reduced.

In all the switching positions of the adjusting valve 20, the inlet I for the fluid to be controlled or regulated feeds into the fluid space 26. In the switching position shown, which corresponds to the switching position of the adjusting valve 20 in FIGS. 3 and 4, the port B feeds into the fluid space 26, and the valve piston 22 separates the fluid space 26 and thus the inlet I from the other port A. The fluid of the partial flow 16 is accordingly fed back into the pressure space 9, while the pressure space 8 is connected to the reservoir 11 via the port A and is thus not connected to pressure. In this switching position, the port A is connected to the outlet O via a space in the valve casing 21 in which the valve spring 25 is arranged, and is connected to the reservoir 11 via the outlet O. If the actuating signal changes its signal level—in the example embodiment, from the lower signal level to the upper signal level—the magnetic coil 27 is supplied with current and shifts the anchor 28 in the axial direction, counter to the force of the valve spring 25, first into the middle switching position and, given a correspondingly long on-time, up to the other extreme switching position, the first switching position. In the middle switching position, the valve piston 22 separates both ports A and B from the fluid space 26, into which the inlet I still feeds. In the first switching position, the valve piston 22 adopts an axial position such that the fluid space 26 axially overlaps both the inlet I and the port A, while the valve piston 22 fluidically separates the port B from the fluid space 26 in the axial position in question. In the first switching position, the fluid of the partial flow 16 is channeled through the fluid space 26 and the port A, into the pressure space 8, while the pressure space 9 is connected to the outlet O and ultimately to the reservoir 11 via the port B and a port C of the valve piston 22.

The valve piston 22 is hollow. The aperture C is formed in a cylindrical surface region of the valve piston 22 which is adjacent to the active surface 24 in the direction of the anchor 28 and together with the surrounding surface of the valve casing 21 forms a narrow sealing gap which fluidically separates the adjusting device 27, 28 from the fluid space 26. A cylindrical surface region of the valve piston 22 is likewise attached to the active surface 23, radially on the outside and away from the adjusting device 27, 28, and forms another narrow sealing gap with the valve casing 21, as long as the adjusting valve 20 does not adopt the first switching position in which the valve piston 22 adopts the axial position in which the fluid space 26 axially overlaps the port A.

The adjusting device 27, 28 comprising the assigned control device connects the adjusting valve 20 over the entire operating range of the assembly 14 and controls or regulates the axial position of the adjusting unit 5-7 and consequently the delivery volume of the displacement pump over the entire range of volume flow which is required for adaptively supplying the assembly 14. The fluidic valve-actuating pressure $P_{20}$ and the valve spring 25 serve as a back-up charging if the adjusting device 27, 28 or the assigned control device fails due to a defect, for example due to a cable break or a detached electrical plug connection. The adjusting valve 20 is configured such that in the event of a failure, the delivery volume of the pump is only adjusted from a maximum in the direction of a minimum once a fluid supply pressure $P_{14}$ has been reached which is greater than a maximum fluid supply pressure $P_{14}$ which is set when the adjusting valve 20 is functioning properly. For this purpose, the valve spring 25 is installed with a biasing force which is greater than a force which is exerted on the valve piston 22 by a maximum valve-actuating pressure $P_{20}$ which can be set during proper functioning.

In the foregoing description, a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled to.

Reference Signs:

1 pump casing
1*a* enclosure
2 inlet
3 outlet
4 delivery member
5 delivery member
6 actuating piston
7 actuating piston
8 pressure space
9 pressure space
10 pump spring
11 reservoir
12 conduit
13 cooling and cleaning device
14 assembly
15 conduit
16 partial flow
17 partial flow
18 conduit
19 conduit
20 adjusting valve
21 valve casing
22 valve piston
23 active surface
24 active surface
25 valve spring
26 fluid space
27 magnetic coil
28 anchor
A port
B port
C aperture
I inlet
O outlet
S valve axis
t period duration
D rotational speed
L load
T temperature
$P_{14}$ fluid supply pressure
$V_{14}$ volume flow
$P_{20}$ valve-actuating pressure
$R_4$ rotational axis
$R_5$ rotational axis

What is claimed:

1. An adjusting valve for adjusting the delivery volume of a displacement pump, said adjusting valve comprising:

a) a valve casing;

b) a hollow valve piston mounted such that the hollow valve piston can be moved within the valve casing, thereby forming two active surfaces for a valve-actuating pressure of a fluid, wherein the valve casing comprises a surrounding surface, which surrounds the hollow valve piston and has a port;

c) a valve spring which counteracts a force exerted by the valve-actuating pressure on the hollow valve piston; and d) an adjusting device, wherein the hollow valve piston is adjustable by the adjusting device in the direction of or counter to the force exerted by the valve-actuating pressure, e) wherein the two active surfaces are arranged to counteract each other and are of different sizes in order to generate a differential force which acts on the hollow valve piston counter to the valve spring and corresponds to a difference in the size of the two active surfaces, and f) wherein the two active surfaces limit the same fluid space and face each other in the direction of the mobility of the hollow valve piston such that the fluid space is located between the two active surfaces, g) wherein the hollow valve piston comprises a cylindrical surface region, which is adjacent to one of the two active surfaces in the direction to the adjusting device and together with said surrounding surface of the valve casing forms a narrow sealing gap which fluidically separates the adjusting device from the fluid space, wherein an aperture is formed in said cylindrical surface region of the hollow valve piston, wherein the hollow valve piston is movable from a position in which said aperture is sealed by the surrounding surface into a position in which said aperture is in flow communication with said port.

2. The adjusting valve according to claim 1, wherein the valve includes at least one of the following features:

the adjusting device can be operated electrically;

the adjusting device is formed as a magnetic adjusting device; or the adjusting device counteracts the force of the valve spring.

3. The adjusting valve according to claim 1, wherein the valve includes at least one of the following features:

the adjusting valve is a proportional valve;

the adjusting valve is controlled or regulated by modulated pulses;

the adjusting valve is current-controlled or current-regulated;

the adjusting valve is voltage-controlled or voltage-regulated;

the adjusting valve comprises at least three ports for the fluid;

the adjusting valve can be switched between at least two switching positions; or the adjusting valve is a port valve.

4. The adjusting valve according to claim 3, wherein the adjusting valve is controlled or regulated by width-modulated pulses.

5. The adjusting valve according to claim 3, wherein the adjusting valve comprises four ports for the fluid.

6. The adjusting valve according to claim 3, wherein the adjusting valve can be switched between three switching positions.

7. The adjusting valve according to claim 1, further comprising:

a control device or regulating device for controlling or regulating a fluid supply pressure to be generated or a volume flow to be delivered by the displacement pump; and a nominal value preset for predetermining at least one pressure nominal value or volume flow nominal value, wherein the control device or regulating device controls or regulates the adjusting device in accordance with the nominal value preset.

8. The adjusting valve according to claim 7, wherein the at least one pressure nominal value or volume flow nominal value is variable in a predetermined way.

9. The adjusting valve according to claim 7, further comprising:

a regulating device for regulating a fluid supply pressure to be generated by the displacement pump;

the nominal value preset for predetermining a nominal value for the fluid supply pressure; and a sensor for ascertaining an actual pressure value of the fluid supply pressure;

wherein the regulating device compares the actual pressure value with the pressure nominal value and controls the adjusting device in accordance with the result of the comparison.

10. The adjusting valve according to claim 9, comprising a checking device, by means of which the adjusting valve can be changed from controlling the fluid supply pressure or volume flow to regulating the fluid supply pressure or volume flow.

11. The adjusting valve according to claim 1, further comprising:

a regulating device for regulating a fluid supply pressure to be generated by the displacement pump;

a nominal value preset for predetermining a nominal value for the fluid supply pressure; and a sensor for ascertaining an actual value of the fluid supply pressure;

wherein the regulating device compares the actual value with the nominal value and controls the adjusting device in accordance with the result of the comparison.

12. The adjusting valve according to claim 11, wherein the nominal value is variable in a predetermined way.

13. The adjusting valve according to claim 1, wherein the valve spring is biased and exerts a biasing force on the hollow valve piston which is greater than a force exerted on the hollow valve piston by a maximum valve-actuating pressure when the adjusting device is functioning properly.

14. The adjusting valve according to claim 1, wherein: the valve casing comprises an inlet, a first port and a second port for a pressure fluid; the hollow valve piston can be moved back and forth between a first position and a second position; and when the hollow valve piston is situated in the first position, the inlet is connected to the first port and separated from the second port, and when the hollow valve piston is situated in the second position, the inlet is connected to the second port and separated from the first port, in order to selectively channel the pressure fluid to the pump either via the first port or via the second port.

15. A displacement pump exhibiting an adjustable delivery volume, and comprising:

a) a pump casing;

b) a delivery chamber which is formed in the pump casing and comprises an inlet for a fluid on a low-pressure side of the displacement pump and an outlet for the fluid on a high-pressure side of the displacement pump;

c) a delivery member, which can be moved within the delivery chamber, for delivering the fluid; and d) an adjusting valve according to claim 1 for adjusting the delivery volume, arranged in a flow of the fluid delivered by the delivery member.

16. The displacement pump according to claim 15, wherein:

an actuating member is movably arranged facing a front face of the delivery member or surrounding the delivery member, for adjusting the delivery volume in the pump casing;

the actuating member can be charged in the direction of its mobility with an actuating force which is dependent on the requirement of an assembly to be supplied with the fluid; and the actuating member and the delivery member are part of an adjusting unit which can be moved back and forth within the pump casing as a complete unit, or one of the actuating member and the delivery member can be adjusted relative to the other and relative to the pump casing.

17. The displacement pump according to claim 16, wherein the displacement pump is a rotational pump, and the delivery member is a delivery rotor arranged in the delivery chamber such that it can rotate about a rotational axis.

18. The displacement pump according to claim 17, wherein a pump spring is arranged to counteract the actuating force.

19. The displacement pump according to claim 16, wherein the actuating member can be charged with the fluid of the high-pressure side of the displacement pump, in order to generate the actuating force.

20. The displacement pump according to claim 19, wherein:

the actuating member forms a double-action actuating piston comprising a first piston surface and a second piston surface which faces away from the first piston surface;

the first piston surface can be charged with a pressure fluid via a first port of the adjusting valve, and the second piston surface can be charged with a pressure fluid via a second port of the adjusting valve; and the hollow valve piston can be moved back and forth between a first position and a second position;

wherein in the first position of the hollow valve piston, the adjusting valve only channels the pressure fluid to the first piston surface, and in the second position of the hollow valve piston, the adjusting valve only channels the pressure fluid to the second piston surface.

21. The displacement pump according to claim 20, wherein the first piston surface can be charged with the fluid of the high-pressure side of the displacement pump.

22. The displacement pump according to claim 20, wherein the second piston surface can be charged with the fluid of the high-pressure side of the displacement pump.

23. The displacement pump according to claim 16, wherein the actuating member can be moved together with the delivery member or relative to the delivery member, axially or transversely in relation to the rotational axis.

24. The displacement pump according to claim 23, wherein the delivery member is in a delivery engagement with another delivery member of the displacement pump, in order to deliver the fluid.

25. The displacement pump according to claim 24, wherein:

the actuating member comprises a first actuating piston and a second actuating piston; and the delivery member is axially arranged between the actuating pistons can be axially moved back and forth together with the actuating pistons as an adjusting unit in the delivery engagement, relative to the other delivery member.

26. The displacement pump according to claim 15, wherein the displacement pump is an external gear pump or an internal gear pump.

27. The displacement pump according to claim 15, wherein the actuating member is an actuating ring which surrounds the delivery member and can be moved transverse to the rotational axis of the delivery member.

28. The displacement pump according to claim 27, wherein the displacement pump is a vane pump, a pendulum slider pump or an internal gear pump.

29. The displacement pump according to claim 15, wherein the fluid delivered by the displacement pump is branched off on the high-pressure side of the displacement pump and fed back to the displacement pump via the adjusting valve.

30. The displacement pump according to claim 29, wherein the fluid delivered by the displacement pump is branched off downstream of a cleaning device.

31. The displacement pump according to claim 29, wherein the fluid being fed back generates a valve-actuating pressure.

32. The displacement pump according to claim 31, wherein the fluid being fed back generates the valve-actuating pressure while flowing through the adjusting valve.

33. The displacement pump according to claim 31, comprising:

a detection device for detecting at least one physical variable which characterizes the fluid requirement of an assembly to be supplied by the displacement pump;

a nominal value preset which forms a nominal value for a volume flow to be delivered or fluid supply pressure to be generated by the displacement pump, in accordance with the at least one detected physical variable; and a control device or regulating device which controls or regulates the adjusting device of the adjusting valve in accordance with the nominal value.

34. The displacement pump according to claim 33, comprising a sensor for ascertaining an actual value of the volume flow or fluid supply pressure, wherein the regulating device forms an actuating variable for the adjusting device of the adjusting valve in accordance with a comparison between the nominal value and the actual value.

35. The displacement pump according to claim 15, further comprising at least one of the following features:

the displacement pump is used as a lubricating oil pump in a vehicle for supplying an internal combustion engine with lubricating oil or supplying an automatic transmission with hydraulic fluid; and/or the displacement pump is driven by the internal combustion engine.

* * * * *